US005920988A

United States Patent [19]

Momose

[11] Patent Number: 5,920,988

[45] Date of Patent: Jul. 13, 1999

[54] ELECTRIC SHAVER

[75] Inventor: Kazuhiro Momose, Nagano, Japan

[73] Assignee: Izumi Products Company, Nagano, Japan

[21] Appl. No.: 09/128,816

[22] Filed: Aug. 4, 1998

[30] Foreign Application Priority Data

Aug. 4, 1997 [JP] Japan ..... 9-209077

[51] Int. Cl.[6] ..... B26B 19/44

[52] U.S. Cl. ..... 30/41; 30/41.7

[58] Field of Search ..... 30/41, 41.5, 41.6, 30/41.7

[56] References Cited

U.S. PATENT DOCUMENTS

| | | | |
|---|---|---|---|
| 4,384,180 | 5/1983 | Meijer et al. . | |
| 5,111,580 | 5/1992 | Bosscha et al. | 30/41.7 |
| 5,240,107 | 8/1993 | Casale | 30/41.7 |
| 5,600,880 | 2/1997 | Becker . | |
| 5,600,888 | 2/1997 | Becker | 30/41.7 |

FOREIGN PATENT DOCUMENTS

| | | |
|---|---|---|
| 02241480 | 9/1990 | European Pat. Off. . |
| 0432849 | 6/1991 | European Pat. Off. . |
| 196 06 719 | 8/1997 | Germany . |
| H64-83289 | 3/1989 | Japan . |

*Primary Examiner*—M. Rachuba
*Attorney, Agent, or Firm*—Koda & Androlia

[57] ABSTRACT

An electric shaver including a display that indicates when it is time to clean the shaving debris accumulated on a shaving debris receiving part that is covered by an outer cutter frame of the shaver. A counting device of the shaver counts the use time (or the load current) of the motor that drives the inner cutter so that a control device compares the counted use time with a preset reference value; and when the counted use time reaches the preset reference value, the control device judges that the time for cleaning has arrived and actuates the display so that the display shows that it is time for cleaning. Thus, the user detaches the outer cutter frame and removes the shaving debris from the shaving debris receiving part in which a light-receiving devices is embedded. When the shaving debris is removed and the light exceeding a preset light quantity impinges on the shaving debris receiving part, the control device detects via the light-receiving device that light exceeding the reference quantity of light has impinged on the shaving debris receiving because of the removal of the shaving debris; as a result, the control device resets the counting device so that the counting device re-starts the count of the use time.

10 Claims, 6 Drawing Sheets

ELECTRIC SHAVER

BACKGROUND OF THE INVENTION

1. Field of the Invention

The present invention relates to an electric shaver.

2. Prior Art

As seen from FIG. 8 that shows a prior art electric shaver 50, shaving debris 52 produced by shaving is collected in a space inside the shaver 50. This space is surrounded by the upper surface 56*a* of a shaver body 56 from which the inner cutter 54 protrudes, an outer cutter frame 58 which is attached, in a detachable manner, to the shaver body 56 so as to cover the upper surface 56*a*, and an outer cutter 60 which is mounted to the outer cutter frame 58. For the most part, such shaving debris falls and accumulates on the upper surface 56*a* of the shaver body 56. Thus, the upper surface 56*a* of the shaver body 56 functions as a shaving debris receiving part, and this is true for both rotary type electric shavers and reciprocating electric shavers.

The shaving debris 52 accumulated on the upper surface 56*a* of the shaver body 56 must be cleaned away. However, since the upper surface 56*a* is hidden by the outer cutter frame 58 and outer cutter 60, it cannot be seen from the outside. As a result, the proper time for performing the cleaning may be missed, and shaving debris 52 would spill out from the outer cutter 60 during shaving. If shaving debris 52 is allowed to accumulate "as is", the cutting capability of the electric shaver drops, and the time required for a single use of the electric shaver increases, resulting in that a driving current for the motor is excessively consumed and the battery consumption accelerates. Furthermore, if shaving debris 52 is allowed to accumulate, various problems occur such as an unpleasant odor, poor hygiene, etc. Accordingly, the periodic cleaning of shaving debris 52 is indispensable for effective and comfortable use of an electric shaver.

In recent years, a new electric shaver has been developed. In this electric shaver, the shaving debris accumulated on the shaving debris receiving part is detected; based upon such a detection, an indication that it is time to clean the shaver is shown on a display 62 of an LED (light-emitting diode) or LCD (liquid crystal display), etc. which is disposed on the shaver body 56 of the electric shaver.

In this electric shaver, the shaving debris is detected by the process as shown in FIG. 9: the use time of the motor 64 which drives the inner cutter 54 (e. g., the time for which the power supply switch 66 is switched on) is counted by an MPU (microprocessor) 68 so as to produce a counted value; when this counted value reaches a preset value, it is judged that the proper cleaning time has arrived; and the fact that the proper cleaning time has arrived is shown on the display 62 so that the user is informed of the time to clean up the shaving debris. This is disclosed in, for instance, Japanese Patent Application Laid-Open (Kokai) No. H1-83289. In other words, the system above utilizes the fact that the accumulation of shaving debris increases as the use time of the electric shaver increases, or as the use time (operating time) of the motor or the ON time of the power supply switch 66 increases.

When the accumulated shaving debris has been cleaned away, it is necessary to perform a new count from the initial value (ordinarily zero); and it is generally true that the outer cutter frame 58 is always removed when the shaving debris 52 is cleaned away. Accordingly, based upon these facts, the shaver is provided with a detecting means 70 for detecting the removal of the outer cutter frame 58 (in which, for example, a detection switch 70 is installed in the attachment position of the outer cutter frame 58 of the shaver body 56), and the MPU 68, that judges that the shaving debris 52 has been cleaned away whenever the outer cutter frame 58 is removed, resets the counted value, thus returning the counted value to the initial (zero) value.

However, some users remove the outer cutter frame 58 before the display 62 indicates that the cleaning time has come so as to look inside the shaver and then just put back the outer cutter frame 58 on the shaver body without cleaning away the shaving debris. There may also be users who remove the outer cutter frame 58 in order to perform cleaning as a result of the indication of the cleaning time shown on the display 62 but re-attach the outer cutter frame 58 without cleaning away the shaving debris because of distractions by some other matter.

In these situations, since the outer cutter frame 58 is removed, the counted value which serves as the basis for judging that the proper cleaning time has arrived returns to the initial value; and as a result, since the users did not remove the shaving debris, a discrepancy subsequently occurs between the accumulation of shaving debris and the display timing with which the display 62 indicates the proper time for cleaning. Thus, even though the shaving debris accumulates beyond the amount at which cleaning is required, the display 62 still does not indicate that it is time for cleaning until the counted value again reaches the preset reference value. Accordingly, the proper time for cleaning is not accurately indicated on the display 62.

SUMMARY OF THE INVENTION

The present invention was devised in order to solve the above-described problems; and the primary object of the present invention is to provide an electric shaver in which the display accurately indicates the proper time for cleaning.

The object of the present invention is accomplished by a unique structure for an electric shaver which comprises: a display means which indicates when it is time to clean out shaving debris that has accumulated on a shaving debris receiving part; a counting means which counts the use time or load current of the motor that drives the inner cutter; and a control means which compares the counted value as counted by the counting means with a preset reference value, judges that the time to clean out shaving debris has arrived when the counted value reaches the reference value, and accordingly actuates the display means so that the display means indicates that it is time to clean out shaving debris; wherein the shaver further comprises a light-receiving means which detects when light exceeding a preset reference quantity of light impinges on the shaving debris receiving part, so that the control means returns the counted value as counted by the counting means to the initial value when it is detected via the light-receiving means that a quantity of light exceeding the reference quantity of light has impinged on the shaving debris receiving part.

The reference quantity of light is set to be the quantity of light that reaches the surface of the shaving debris receiving part when the outer cutter frame that covers the inner cutter is detached and the shaving debris on the shaving debris receiving part is removed.

With the above structure, the counted value returns to the initial value only when the user removes the outer cutter frame from the shaving debris receiving part and then actually cleans out the shaving debris accumulated on the shaving debris receiving part so that the quantity of light impinging on the shaving debris receiving part exceeds the reference quantity of light. Accordingly, when the user removes the outer cutter frame and then re-attaches the outer cutter frame without cleaning away the shaving debris, the counted value does not return to the initial value as it does in conventional electric shavers; as a result, the count of the motor use time or the count of the amount of the load current continues, and the proper time for cleaning can be accurately counted and indicated with no discrepancy between the accumulation of shaving debris and the timing with which the display indicates that this proper time for cleaning has arrived.

In the structure described above, the light-receiving means may be constructed with a light-receiving element installed in the shaving debris receiving part so that the light-receiving element detects the quantity of light impinging on the shaving debris receiving part. Alternatively, the light-receiving means may be constructed with a light-transmitting member, which is attached to the shaving debris receiving part at one end thereof, and a light-receiving element, which is disposed at another end of the light-transmitting member inside the shaver body, so the light which impinges on the shaving debris receiving part is transmitted from the light-transmitting member to the light-receiving element. Furthermore, one end of the lighttransmitting member may be attached to the shaving debris receiving part via a lens, so that light is collected by this lens and transmitted to the light-receiving element.

The above object is further accomplished by another unique structure for an electric shaver which comprises: a display means which indicates when it is time to clean out shaving debris that has accumulated on a shaving debris receiving part; a counting means which counts the use time or load current of the motor that drives the inner cutter; and a control means which compares the counted value as counted by the counting means with a preset reference value, judges that the time to clean out shaving debris has arrived when the counted value reaches the reference value, and accordingly actuates the display means so that the display means indicates that it is time to clean out shaving debris; wherein the shaver further comprises a shaving debris detection means which detects the presence or absence of shaving debris, so that the control means returns the counted value counted by the counting means to the initial (zero) value when it is detected via the shaving debris detection means that no shaving debris is present.

In the above structure, the counted value as counted by the counting means is returned to the initial value only after the shaving debris is actually cleaned away. Accordingly, the time at which the counting operation of the counting means is initiated always corresponds to the time at which the accumulation of shaving debris actually begins; and even in cases where the user detaches the outer cutter frame during use and then re-attaches the outer cutter frame without cleaning away the shaving debris, the count continues without returning the counted value to the initial value as in conventional electric shavers. Accordingly, the proper time for cleaning can be accurately shown on the display without any discrepancy between the accumulation of shaving debris and the timing with which the display indicates the time for cleaning.

It is advisable to form the shaving debris detection means with a light-emitting device and a light-receiving device which are disposed so as to face each other on the shaving debris receiving part with a certain distance in between. Thus, the presence of shaving debris is detected when shaving debris accumulated between the light-emitting device and light-receiving device blocks the light traveling between these two devices; and the absence of shaving debris is detected when shaving debris accumulated between the light-emitting device and light-receiving device is removed and the light emitted from the light-emitting device is received by the light-receiving device.

DETAILED DESCRIPTION OF THE PREFERRED EMBODIMENTS

Figure 1:
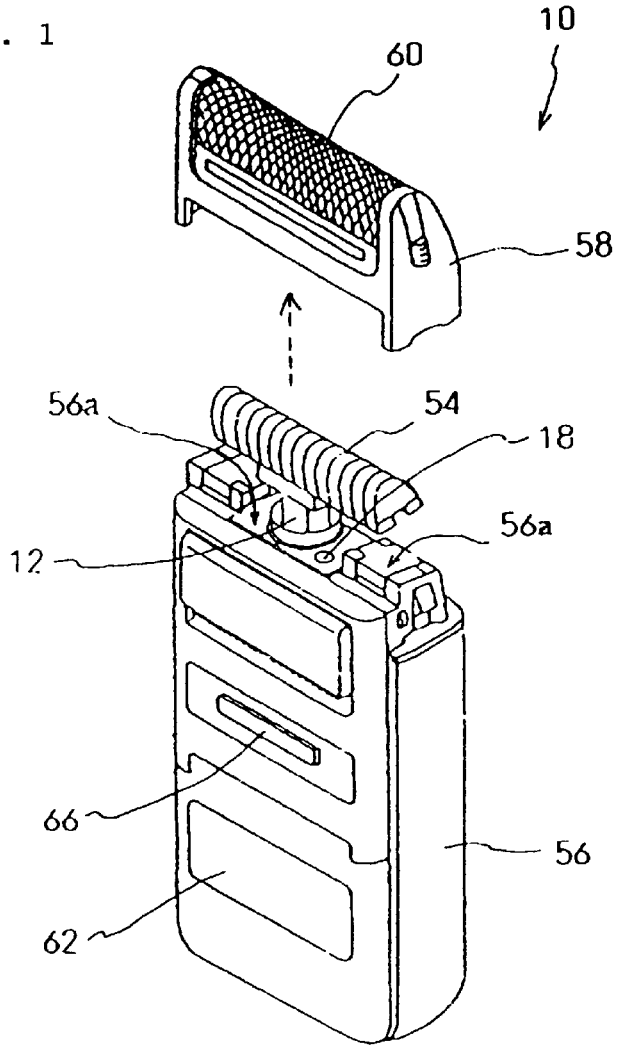
FIG. 1 is a perspective view showing the structure of a first embodiment of the electric shaver according to the present invention with the outer cutter frame detached.

Preferred embodiments of the electric shaver of the present invention will be described in detail with reference to the accompanying drawings. Parts which are the same as in the prior art shaver are labeled with the same reference numerals, and a detailed description of such parts is omitted. Moreover, the description below is made for a reciprocating electric shaver as an example; and it should be noted that the present invention can be applied to rotary type electric shavers as well.

First, the structure of the electric shaver 10 will be described with reference to FIGS. 1 through 4.

A drive shaft 12 extends from the inside of the shaver body 56, and its upper end is disposed on the upper surface 56*a* of the shaver body 56 with an inner cutter 54 attached to the upper end of the drive shaft 12. An outer cutter frame 58 that has an outer cutter 60 is attached to the shaver body 56 in a detachable manner so that the outer cutter frame 58 covers the inner cutter 54 and the upper surface 56*a*. The outer cutter 60 of the outer cutter frame 58 is formed with fine hair entry apertures.

Hair cut by the inner cutter 54 and outer cutter 60 are collected as shaving debris 52 in the space that is surrounded by the upper surface 56*a* of the shaver body 56, the outer cutter frame 58 and the outer cutter 60. Though some of this shaving debris 52 may adhere to the surface of the inner cutter 54, the shaving debris 52 for the most part falls and accumulates on the upper surface 56*a* of the shaver body 56. Thus, the upper surface 56*a* of the shaver body 56 functions as a shaving debris receiving part and is referred to as the "shaving debris receiving part" in the description below.

Figure 2:
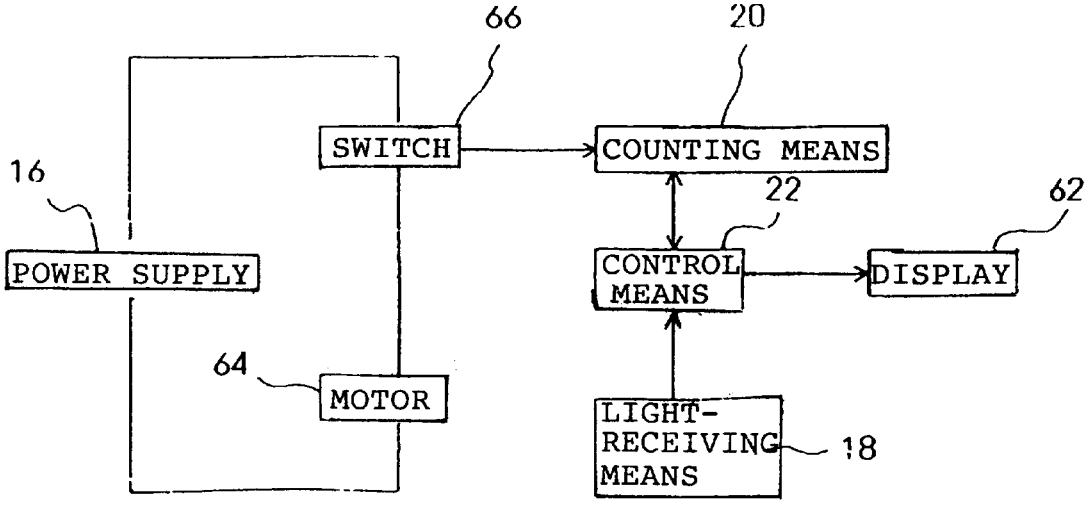
FIG. 2 is a block diagram of the shaver of FIG. 1.

A power supply switch (also referred to simply as a "switch") 66 and a display 62 which indicates when it is time for cleaning are disposed on the front surface (or side surface) of the shaver body 56. As shown in FIG. 2, inside the shaver body 56 are disposed a motor 64 which causes a reciprocating movement of the inner cutter 54 via the drive shaft 12, a power supply 16 (as in the prior art, this may be a battery or an AC power supply) for the motor 64, a light-receiving means 18, a counting means 20 which counts the use time of the motor 64 that drives the inner cutter 54, and a control means 22 which controls the entire operation of the electric shaver 10.

The counting means 20 may be designed so as to count the load current that flows from the power supply 16 to the motor 64 instead of counting the use time of the motor 64.

The counting means 20, in this embodiment, is a counter which adds up the time for which the switch 66 is in an ON position; and as a result, the use time of the motor 64 is counted by the counting means 20. The counting means 20 begins counting from an initial value which is preset by the control means 22. This initial value is ordinarily zero; however, any positive value other than zero may be set as the initial value.

The display 62 is constructed using an LED or LCD. For example, when an LED is used, the LED lights up only when it is time for cleaning; and when a LCD is used, the LCD shows a message stating that the time for cleaning has arrived. Alternatively, an LCD or a plurality of LED's can be used so that a display in stages is performed that correspond to the counted value produced by the counting means 20, so that the user is able to know the degree of accumulation of shaving debris directly from the outside.

Next, the light-receiving means 18 and control means 22, which are the characteristic parts of the electric shaver 10 of the present invention, will be described in detail.

The light-receiving means 18 detects the light that exceeds a preset reference quantity of light impinging on the shaving debris receiving part 56*a*. In concrete terms, this reference quantity of light is set to be the quantity of light that reaches the shaving debris receiving part 56*a* when the outer cutter frame 58 that includes the outer cutter 60 is removed, and then the shaving debris 52 is cleaned away from the shaving debris receiving part 56*a*.

Figure 3:
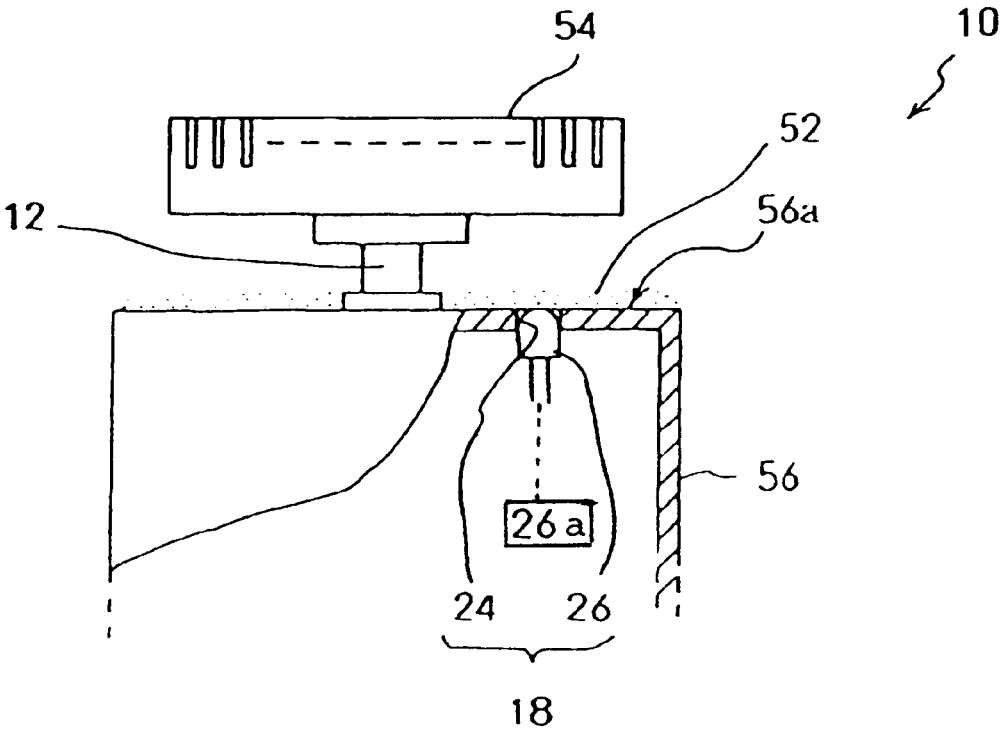
FIG. 3 is a partially sectional view of the essential portion of a shaving debris detecting section used in the electric shaver shown in FIG. 1.

In the present embodiment, as shown in FIG. 3, the light-receiving means 18 is comprised of a light-receiving element (photodiode or phototransistor, etc.) 26 and an output circuit 26*a*. The light-receiving element 26 is disposed in a window 24 opened in the shaving debris receiving part 56*a*, and it outputs an electrical signal when the light impinges thereon; and the output circuit 26*a* is disposed inside the shaver body 56 and connected to the light-receiving element 26. The output circuit 26*a* outputs a detection signal that determines that shaving debris 52 is not present when the electric signal level outputted by the light-receiving element 26 becomes equal to or greater than a predetermined value because of the light that is equal to or greater than the reference quantity of light and received by the light-receiving element 36. Thus, in this embodiment, the quantity of light that reaches the shaving debris receiving part 56*a* is detected by the quantity of light that reaches the light-receiving element 26.

The quantity of light that reaches the shaving debris receiving part 56*a* when the outer cutter frame 58 is detached from the shaver body 56 and the shaving debris 52 is removed from the shaving debris receiving part 56*a* would differ depending on whether the light involved is indoor lighting or outdoor light. Accordingly, when the reference quantity of light is set based upon the light of indoor lighting (which is generally weak), the quantity of light received by the light-receiving element 26 may exceed the reference quantity of light and the output circuit outputs the detection signal, if the outer cutter frame 58 is detached under the outdoor light and cleaning is finished incompletely with a slight amount of shaving debris remaining on the light-receiving element 26. However, the fact that cleaning has been performed tentatively can be detected even in such a case.

In the embodiment of FIG. 3, the window 24 is formed as a through-hole opened in the shaving debris receiving part 56*a*, and the light-receiving element 26 is fitted inside this through-hole (or window 24). Alternatively, however, it is also possible, for example, to form the window 24 from a through-hole formed in the shaving debris receiving part 56*a* and fit a plate member made of a transparent glass material or synthetic resin material inside the through-hole (window 24) so as to close off the through-hole and further to install the light-receiving element 26 inside the shaver body 56 with its light-receiving surface facing the plate member. When the light-receiving element 26 is installed inside a through-hole (or window 24) as shown in FIG. 3, it is necessary to avoid any gap or space between the outer circumference of the light-receiving element 26 and the inner circumference of the through-hole so as to avoid shaving debris 52 from penetrating into the interior of the shaver body 56 through such a gap; however, with the structure that includes the window 24 closed off by the plate member, no shaving debris 52 will penetrate into the shaver body 56, and therefore, such a structure is preferable.

In the above embodiment, a single light-receiving means 18 which detects light impinging on the shaving debris receiving part 56*a* is employed. It is, however, further possible to install a plurality of light-receiving means 18 in order to detect the light impinging on the surface of the shaving debris receiving part 56*a* in two or more places. With this structure, the fact that the cleaning has been performed can be known only when shaving debris 52 has been removed from the shaving debris receiving part 56*a* to a certain overall extent rather than just locally. Moreover, depending on how the electric shaver 10 is held, there may be cases in which the light-receiving means 18 is positioned in the shadow of the inner cutter 54. However, with the structure that includes a plurality of light-receiving means 18, whether or not the cleaning of the shaving debris 52 has been done can be detected by other light-receiving means 18 which are not in the shadow. Thus, the precision of detection can be improved.

Figure 4:
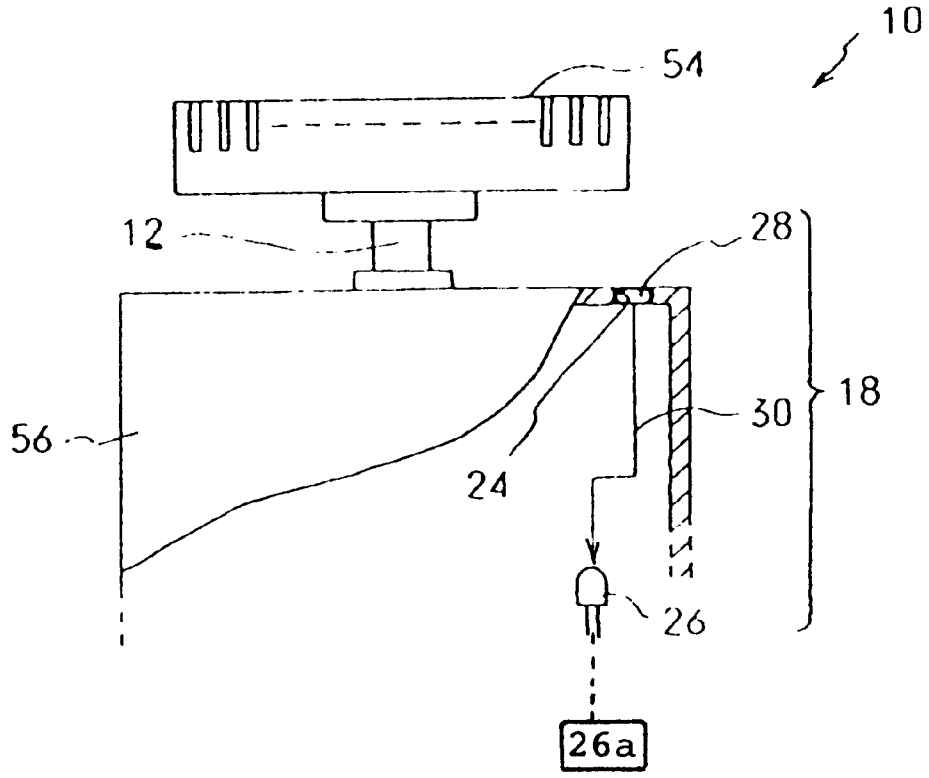
FIG. 4 is a sectional view of the essential portion of another shaving debris detecting section used in the electric shaver shown in FIG. 1.

FIG. 4 shows another structure of the light-receiving means 18. In this embodiment, the light-receiving means 18 comprises a focusing lens 28 installed in the window 24, a light-receiving element 26 disposed inside the shaver body 56, a light-transmitting member 30 installed between the lens 28 and light-receiving element 26 so as to transmit light from the lens 28 to the light-receiving element 26. A control circuit 26*a* as described with reference to the structure of FIG. 3 is also provided. A generally known optical fiber or a cylindrical or plateform material formed from a transparent synthetic resin, etc. can be used as the light-transmitting member 30, and the lens 28 and light-receiving element 26 are installed so as to be at both ends of this optical fiber or cylindrical or plate-form material.

With this structure, the position of the light-receiving element 26 can be selected as desired inside the shaver body 56, and the degree of freedom in designing the electric shaver can increase. Furthermore, with the use of the optical fiber 30 which is fine in diameter and the cylindrical shaver body synthetic resin which has a small cross-sectional area, it is possible to use a lens 28 that has a smaller diameter than the light-receiving element 26, so that the size (or the inner diameter) of the window 24 itself to which the lens 28 is fitted can be reduced.

Furthermore, with the use of the lens 28, more light can be collected; therefore, the light-receiving element 26 can detect even weak light such as indoor light, etc. Thus, the presence or absence of shaving debris 52 is detected with high precision. However, if light can be sufficiently transmitted to the light-receiving element 26 via the light-transmitting member 30 alone by way of the use of the light-transmitting member 30 which has little light attenuation or of the light-receiving element 26 which has a good sensitivity, it is not necessary to collect the light using the lens 28. In such cases, a sufficient light can be transmitted to the light-receiving element 26 through one end of the light-transmitting member 30 attached directly to the shaving debris receiving part 56*a*.

Accordingly, even in cases where the shaving debris receiving part 56*a* has a complicated shape and does not have a space for directly attaching the light-receiving element 26 thereon, it is possible to install the light-receiving element 26 in the shaver. Furthermore, since the window 24 can be formed with a diameter as small as possible, a plurality of windows 24, lenses 28 and light-transmitting members 30 can be installed. By thus forming a plurality of windows 24 over the entire surface of the shaving debris receiving part 56*a* and using a plurality of lenses 28 and light-transmitting members 30, a judgement that cleaning has been performed can be made only when shaving debris 52 has been removed from the entire surface of the shaving debris receiving part 56*a* instead of just locally.

Furthermore, it is also possible to design the present invention so that the quantity of accumulated shaving debris 52 and the counted value are matched by reducing the counted value as counted by the counting means 20 based upon the number of areas in which the light quantity has exceeded the reference light quantity as a result of shaving debris 52 being cleaned away, thus causing the count operation to return so that the indication of the time for cleaning is delayed. The reason for this is that there may be cases in which the outer cutter frame 58 is attached after shaving debris 52 has been cleaned away from only a portion of the shaving debris receiving part 56*a*; in such cases, the quantity of accumulated shaving debris 52 and the counted value will become mismatched if the count operation continues with the counted value left "as is", or if the counted value is returned to the initial value.

As seen from the above, the light-receiving means 18 is employed, and it detects when light that exceeds the preset reference quantity of light impinges on the surface of the shaving debris receiving part 56*a*. Accordingly, outside light strikes the light-receiving element 26 and a detection signal is outputted by the light-receiving means 18 only when the outer cutter frame 58 is detached and accumulated shaving debris 52 is actually cleaned away. There may be cases in which a slight amount of light reaches the light-receiving element 26 through the hair entry apertures of the outer cutter 60 or via gaps in the accumulated shaving debris 52. However, a malfunction that might be caused by such incident can be avoided by adjusting the output circuit 26*a* and setting it beforehand so that no detection signal is outputted in cases where the outer cutter frame 58 is attached or in cases where accumulated shaving debris 52 is present on the light-receiving element 26 even though the outer cutter frame 58 has been detached.

Next, the control means 22 will be described in more detail.

As one example, the control means 22 is constructed using an MPU and a non-volatile memory (not shown). The control means 22 compares the counted value counted by the counting means 20 with a preset reference value; and when the counted value exceeds the reference value, the control means 22 judges that the time for cleaning has been reached and actuates the display 62 so that the display 62 shows that it is time for cleaning. Furthermore, the control means 22 detects the presence or absence of detection signals from the light-receiving means 18.

The counted value of the motor use time obtained by the counting means 20 is stored in the above-referred memory in the control means 22; and the reference value that is compared with this counted value is also stored in the memory. Moreover, when the control means 22 judges that the time for cleaning has been reached, information indicating that the time for cleaning has been reached is also stored in the memory.

The counting means 20 may be constructed using a counter, etc. as in the embodiment described above; however, a construction in which an MPU acts as both the control means 22 and counting means 20 may of course also be employed.

Figure 5:
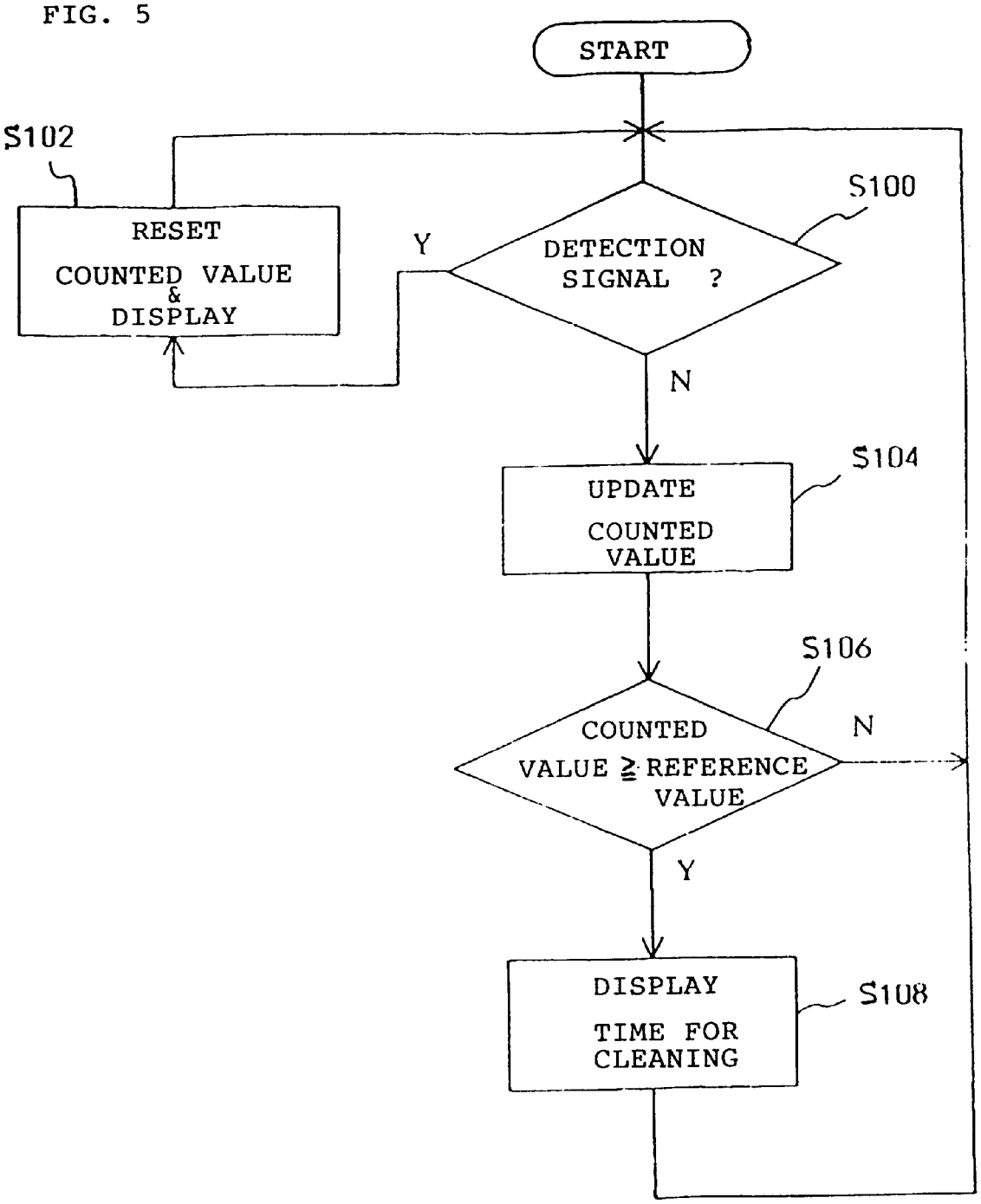
FIG. 5 is a flow chart illustrating the operation of the electric shaver shown in FIG. 1.

Next, the overall operation of the electric shaver 10 will be described with reference to FIG. 5 in addition to FIGS. 1 and 2. The counting means is in the initial state after the resetting is made, and the counted value is at the initial (zero) value; and in addition, it is assumed in this operation that no shaving debris has yet accumulated on the shaving debris receiving part.

When the switch 66 is turned from the OFF position to the ON position in order to start shaving, electric current is supplied to the motor 64 from the power supply 16 so that the motor 64 is actuated, and the inner cutter 54 is driven to oscillate.

Hairs that enter the interior of the outer cutter 60 through the hair entry apertures formed therein are cut between the oscillating inner cutter 54 and the outer cutter 60 only while the switch 66 remains in the ON position. The shaving debris 52 produced by this cutting successively accumulates on the shaving debris receiving part 56*a*, covering the light-receiving element 26.

The counting means 20 counts the time for which the switch 66 is ON (i. e., the use time) beginning from a preset initial value.

In the control means 22, the presence or absence of a detection signal from the light-receiving means 18 is constantly monitored (step S1 00). When the detection signal is detected, the counting means 20 is reset so that the counted value returns to the initial (zero) value. In other words, the counted value is always reset when the outer cutter frame 58 is actually removed and the shaving debris 52 that has accumulated on the shaving debris receiving part 56*a* and light-receiving element 26 is cleaned away or removed by the user. The control means 22 also resets the display 62 and erases the indication that it is time for cleaning (step S102). In case the counting means 20 does not have such a function to reset the counted value, the resetting may be accomplished by reading out the initial value from the memory and then resetting the counting means 20 when the control means 22 stops the counting operation of the counting means 20.

Furthermore, in the control means 22, the most recent counted value counted by the counting means 20 is taken in and stored in the memory so that the counted value is updated (step S104); and this counted value is compared with the reference value stored in the memory (step S106).

Then, when the counted value agrees with the reference value or exceeds the reference value, the control means 22 judges that the time for cleaning has been reached and actuates the display 62 so that the user is informed that it is time for cleaning (step S108). As one example, when the control means 22 detects that the time for cleaning has arrived, information indicating that the time for cleaning has arrived is stored by setting a cleaning flag in a prescribed region of the memory, etc. This stored information that indicates the arrival of the time for cleaning is reset when the control means 22 detects the detection signal.

Moreover, in cases where the switch 66 is in an OFF stage, the counting means 20 does not perform counting, and the control means 22 does not take in the counted value or perform a comparison with a stored or reference value. Furthermore, since the memory is a non-volatile memory, a counted value once stored is retained.

Thus, every time shaving is performed with the switch 66 in an ON position, count of the use time by the counting means 20 is successively performed; and in the electric shaver 10 of the present invention, the counted value counted by the counting means 20 is reset and returned to the initial value only when the control means 22 detects a detection signal, i. e., only when the outer cutter frame 58 is removed and the accumulated shaving debris 52 is actually cleaned away. Accordingly, the count process always starts immediately after the shaving debris has been cleaned away, so that accurate timing for cleaning can be indicated.

In other words, when the outer cutter frame 58 of the electric shaver 10 is removed during use and is then re-attached without cleaning away the shaving debris 52, the resetting of the counting value is not performed. Accordingly, count of the use time continues in accordance with the conditions of accumulation of shaving debris 52, and an accurate indication that it is time for cleaning is shown on the display 62. This indication that it is time for cleaning continues to be displayed until the accumulated shaving debris 52 is cleaned away. Accordingly, the user can be urged to clean out the shaving debris 52.

Figure 6:
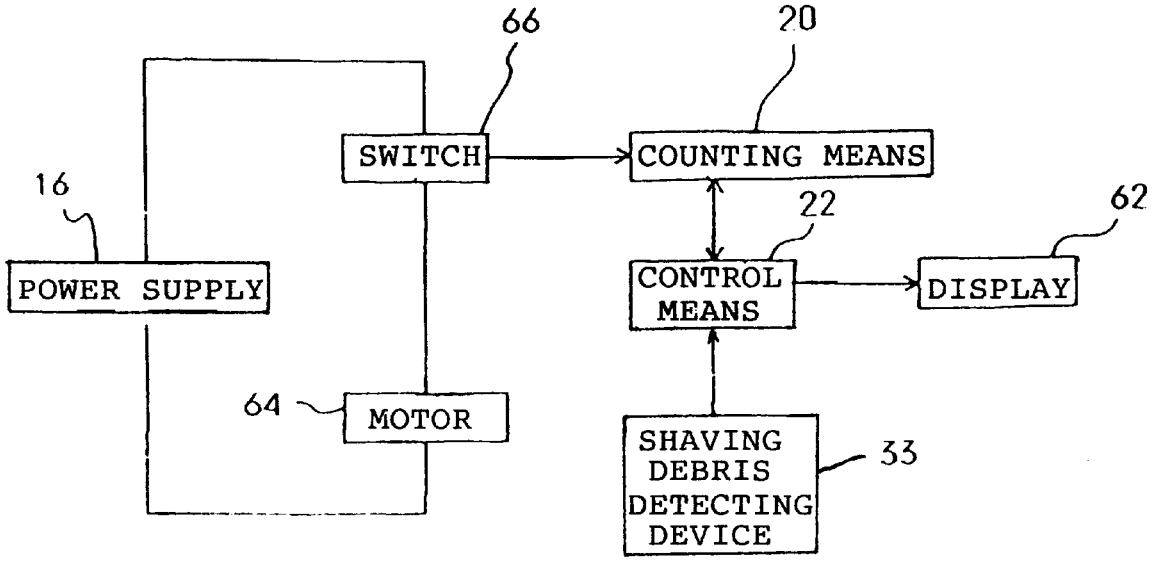
FIG. 6 is a block diagram of a second embodiment of the electric shaver according to the present invention.
Figure 7:
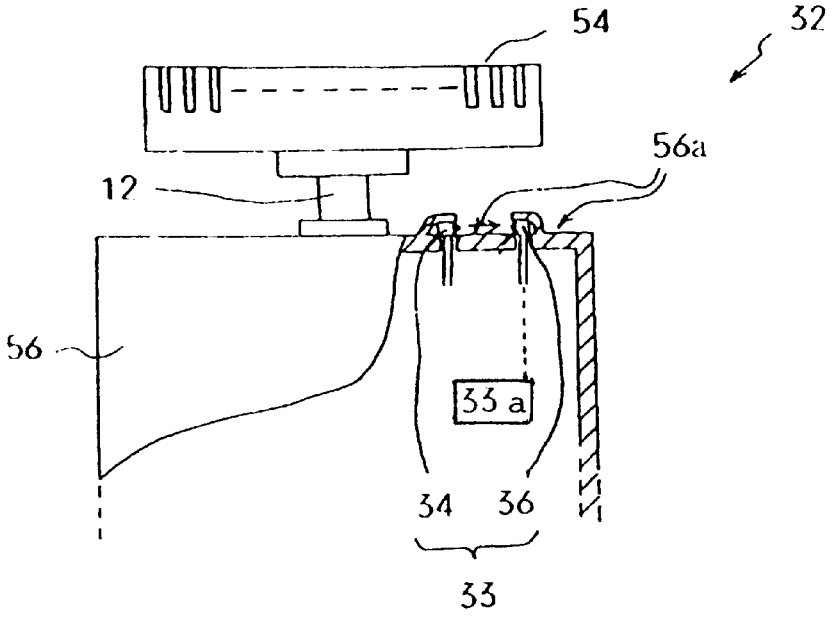
FIG. 7 is a partially sectional view of the essential portion of the shaver of FIG. 6.
Figure 8:
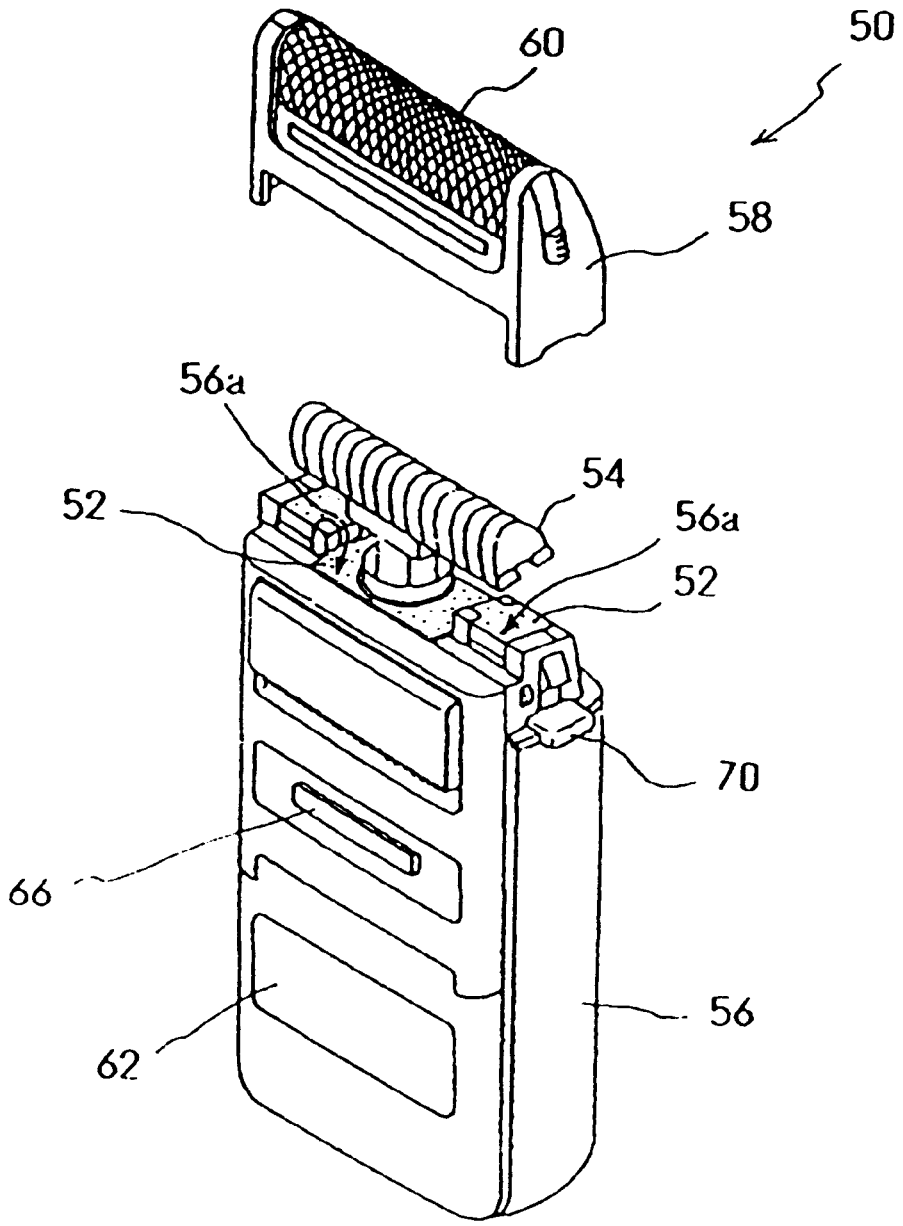
FIG. 8 PRIOR ART
FIG. 8 is a perspective view of a conventional electric shaver with the outer cutter frame detached.
Figure 9:
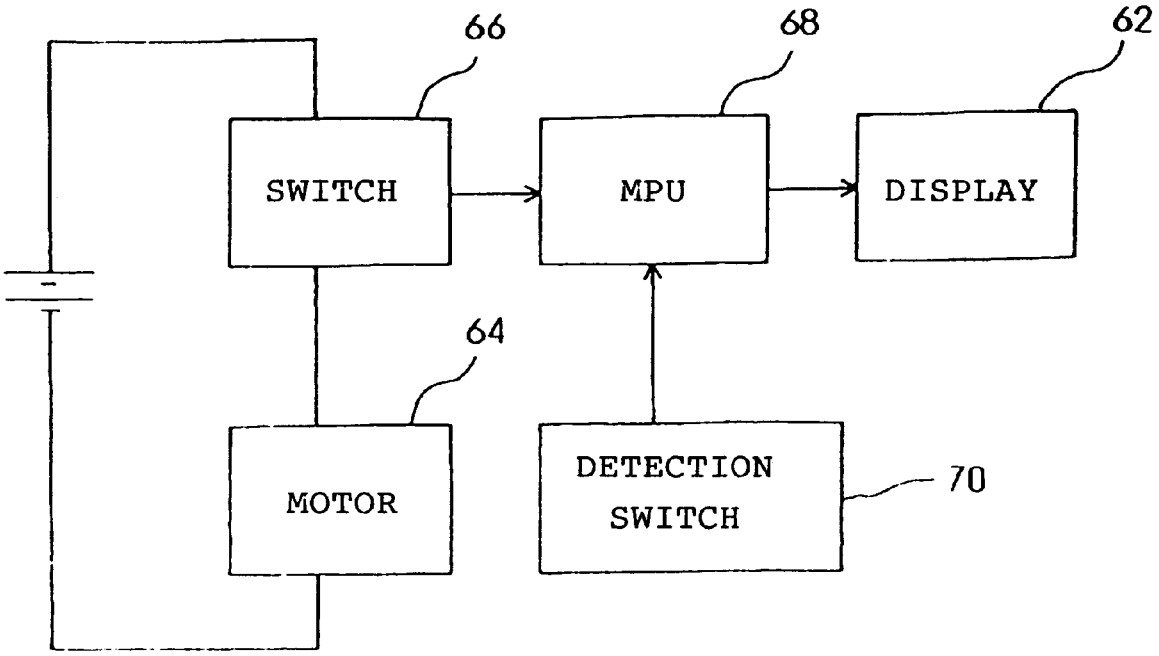
FIG. 9 PRIOR ART
FIG. 9 is a block diagram used in the electric shaver of FIG. 8.

The second embodiment of the present invention will be described below with reference to FIGS. 6 and 7.

The basic construction of the electric shaver 32 of the second embodiment is substantially the same as that of the electric shaver 10 shown in FIGS. 1 through 5. As shown in FIG. 6, the electric shaver 32 of the second embodiment differs from the electric shaver 10 of the first embodiment in that the electric shaver 32 includes a shaving debris detection means 33 which detects the presence or absence of shaving debris 52 instead of the light-receiving means 18, and the control means 22 returns the counted value to the initial value when it is detected via the shaving debris detection means 33 that no shaving debris 52 is present.

More specifically, the shaving debris detection means 33 comprises a light-emitting device 34 and a light-receiving device 36 which are installed so as to face each other with a certain distance in between on the shaving debris receiving part 56*a*. With this structure, the presence of shaving debris 52 on the shaving debris receiving part 56*a* is detected when shaving debris 52 has accumulated between the light-emitting device 34 and the light-receiving element 36 and therefore the light from the light-emitting device 34 is blocked by the shaving debris 52 and cannot be detected by the light-receiving device 36; on the other hand, the absence of the shaving debris 52 is detected when the shaving debris 52 has been removed and therefore the light from the light-emitting device 34 is detected by the light-receiving device 36. Alternatively, the shaving debris detection means 33 may have a construction that uses a light-receiving means 18 as in the first embodiment; in other words, the presence or absence of accumulated shaving debris 52 on the light-receiving means 18, i. e., on the shaving debris receiving part 56*a*, is detected according to the quantity of light received by the light-receiving means 18.

In the second embodiment, as in the case of the first embodiment, the shaving debris detection means 33 is provided with an output circuit 33*a*; and the output circuit 33*a* outputs a detection signal that determines that shaving debris 52 is not present, when the electric signal level outputted by the light-receiving device 36 becomes equal to or greater than a predetermined value because of the light that is equal to or greater than the reference quantity of light and received by the light-receiving device 36.

A light-emitting element (light-emitting diode, etc.) is used as the light-emitting device 34 and a light-receiving element (phototransistor or photodiode, etc.) can be utilized as the light-receiving device 36. Furthermore, it is also possible to use light-transmitting members such as optical fibers, etc. as in the first embodiment. In this case, the respective ends of two light-transmitting members are installed on the shaving debris receiving part 56*a* so as to face each other, and each of the light-emitting device 34 and light-receiving device 36 is connected to the other end of each light-transmitting member.

In the above structure, when light is not transmitted from the light-emitting device 34 to the light-receiving device 36 via the two light-transmitting members, the level of the electrical signal outputted by the light-receiving device 36 is below the predetermined value that is set in the output circuit; accordingly, the control means 22 judges that shaving debris 52 has accumulated. On the other hand, when light is transmitted from the light-emitting device 34 to the light-receiving device 36 through the two light-transmitting members, then, the level of the electrical signal outputted by the light-receiving device 36 becomes equal to greater than the predetermined value that is set in the output circuit; accordingly, the detection signal is outputted, and the control means 22 determines that shaving debris 52 has been removed and no shaving debris 52 is present on the shaving debris receiving part 56*a*.

In the above structure as well, the counted value of the use time is not reset if the outer cutter frame 58 of the electric shaver 10 is removed during use and then re-attached without cleaning away the shaving debris 52. Accordingly, count of the use time continues in accordance with the accumulation of shaving debris 52, and the time for cleaning can be accurately indicated on the display 62. Furthermore, as in the first embodiment, the indication that it is time for cleaning continues to be displayed until cleaning is actually performed; accordingly, the user can be constantly urged to clean out the shaving debris 52.

Various preferred embodiments of the present invention are described above. However, the present invention is not limited to the embodiments described above, and it goes without saying that various modifications may be made within limits not departing from the spirit of the invention.

As seen from the above, according to the present invention, the counted value obtained by the counting means is returned to the initial value only when shaving debris is actually cleaned away. Accordingly, the time at which the count operation is initiated by the counting means can always coincide with the time at which the accumulation of shaving debris actually begins. Thus, even in cases where the outer cutter frame is temporarily removed during use and then re-attached without cleaning the shaving debris, the counted value does not return to the initial value as it does in prior art shavers; instead, the count operation continues so that the proper time for cleaning can be accurately indicated without any discrepancy between the accumulation of shaving debris and the timing of the indication by the display which shows that it is time for cleaning. Furthermore, the display continues to indicate that it is time for cleaning until cleaning is completely performed, thus the user is urged to perform the cleaning. Accordingly, if the user re-attaches the outer cutter frame without cleaning away the shaving debris, the display continuously shows that it is time for cleaning, so that the user will notice the display and clean away the shaving debris.

I claim:

1. An electric shaver comprising: a display means which indicates when it is time to clean out shaving debris that has accumulated on a shaving debris receiving part of said electric shaver, a counting means which counts a use time or load current of a motor that drives an inner cutter of said electric shaver, and a control means which compares a counted value counted by said counting means with a preset reference value, judges that said time to clean out shaving debris has been reached when said counted value reaches said reference value, and actuates said display means so that said display means indicates that it is time to clean out shaving debris, wherein said electric shaver further comprises:

a light-receiving means which detects when light exceeding a preset reference quantity of light impinges on said shaving debris receiving part, so that said control means returns said counted value counted by said counting means to an initial value when it is detected via said light-receiving means that a quantity of light exceeding said reference quantity of light has impinged on said shaving debris receiving part.

2. An electric shaver according to claim 1, wherein said reference quantity of light is set to be a quantity of light that reaches a surface of said shaving debris receiving part when an outer cutter frame that covers said inner cutter is detached and no shaving debris present on said shaving debris receiving part.

3. An electric shaver according to claim 1, wherein said light-receiving means comprises a light-receiving element which is attached to said shaving debris receiving part.

4. An electric shaver according to claim 2, wherein said light-receiving means comprises a light-receiving element which is attached to said shaving debris receiving part.

5. An electric shaver according to claim 1, wherein said light-receiving means comprises a light-transmitting member, one end thereof being disposed on said shaving debris receiving part, and a light-receiving member connected to another end of said light-transmitting member.

6. An electric shaver according to claim 2, wherein said light-receiving means comprises a light-transmitting member, one end thereof being disposed on said shaving debris receiving part, and a light-receiving member connected to another end of said light-transmitting member.

7. An electric shaver according to claim 5, wherein said one end of said light-transmitting member is attached to said shaving debris receiving part via a lens.

8. An electric shaver according to claim 6, wherein said one end of said light-transmitting member is attached to said shaving debris receiving part via a lens.

9. An electric shaver comprising: a display means which indicates when it is time to clean out shaving debris that has accumulated on a shaving debris receiving part of said electric shaver, a counting means which counts a use time or load current of a motor that drives an outer cutter of said electric shaver, and a control means which compares a counted value counted by said counting means with a preset reference value, judges that said time to clean out shaving debris has been reached when said counted value reaches said reference value, and actuates said display means so that said display means indicates that it is time to clean out shaving debris, wherein said electric shaver further comprises:

a shaving debris detection means which detects a presence or absence of shaving debris, so that said control means returns said counted value counted by said counting means to said initial value when it is detected via said shaving debris detection part that no shaving debris is present.

10. An electric shaver according to claim 9, wherein said shaving debris detection means comprises a light-emitting member and a light-receiving member provided so as to face each other with a space in between on said shaving debris receiving part, and said shaving debris detection means detects said absence of said shaving debris when said shaving debris is removed and said light-receiving member receives a light transmitted by said light-emitting member.

* * * * *